United States Patent [19]

Greiner

[11] 4,437,403

[45] Mar. 20, 1984

[54] SYSTEM FOR ADJUSTING PRINTING PLATES MOUNTED ON PLATE CYLINDERS

[75] Inventor: Harry M. Greiner, Offenbach am Main, Fed. Rep. of Germany

[73] Assignee: M.A.N. Roland Druckmaschinen Aktiengesellschaft, Fed. Rep. of Germany

[21] Appl. No.: 418,094

[22] Filed: Sep. 14, 1982

[30] Foreign Application Priority Data

Sep. 16, 1981 [DE] Fed. Rep. of Germany ..... 3136704

[51] Int. Cl.[3] ..... B41F 13/24

[52] U.S. Cl. ..... 101/248

[58] Field of Search ..... 101/248, 216, 181, 426, 101/DIG. 12; 226/3, 27, 29, 30, 45

[56] References Cited

U.S. PATENT DOCUMENTS

| | | | |
|---|---|---|---|
| 1,151,461 | 8/1915 | Hatt | 101/DIG. 12 |
| 3,073,997 | 1/1963 | Tagliasacchi | 101/248 X |
| 3,468,201 | 9/1969 | Adamson et al. | 226/29 X |
| 3,561,654 | 2/1971 | Greiner | 226/30 |
| 3,915,090 | 10/1975 | Horst et al. | 101/DIG. 12 |
| 4,135,664 | 1/1979 | Resh | 226/3 |

FOREIGN PATENT DOCUMENTS

| | | | |
|---|---|---|---|
| 2702274 | 7/1978 | Fed. Rep. of Germany | 101/781 |
| 56-28864 | 3/1981 | Japan | 101/248 |
| 7808954 | 3/1980 | Netherlands | 101/181 |
| 2024457 | 1/1980 | United Kingdom | 101/248 |
| 2072097 | 9/1981 | United Kingdom | 101/181 |
| 499198 | 3/1976 | U.S.S.R. | 226/30 |

*Primary Examiner*—E. H. Eickholt

*Attorney, Agent, or Firm*—Leydig, Voit, Osann, Mayer & Holt, Ltd.

[57] ABSTRACT

An automatic control method and apparatus for adjusting the register of printing plates in a multi-color printing press before test sheets or proofs are printed. Register marks are copied on the printing plates when the plates are manufactured. Photoelectric scanners sense the register marks and determine the relative positions of the printing plates without the use of paper. The positions of the printing plates are compared and the plate cylinders are adjusted so that the printing plates of all the plate cylinders are in register with one another. Preferably the relative positions are referenced to registered zero positions in the middle of the adjustment range for each plate cylinder, and the position of the printing plate having the least deviation from the corresponding zero position is chosen as a reference position to which the positions of the other printing plates are compared.

10 Claims, 10 Drawing Figures

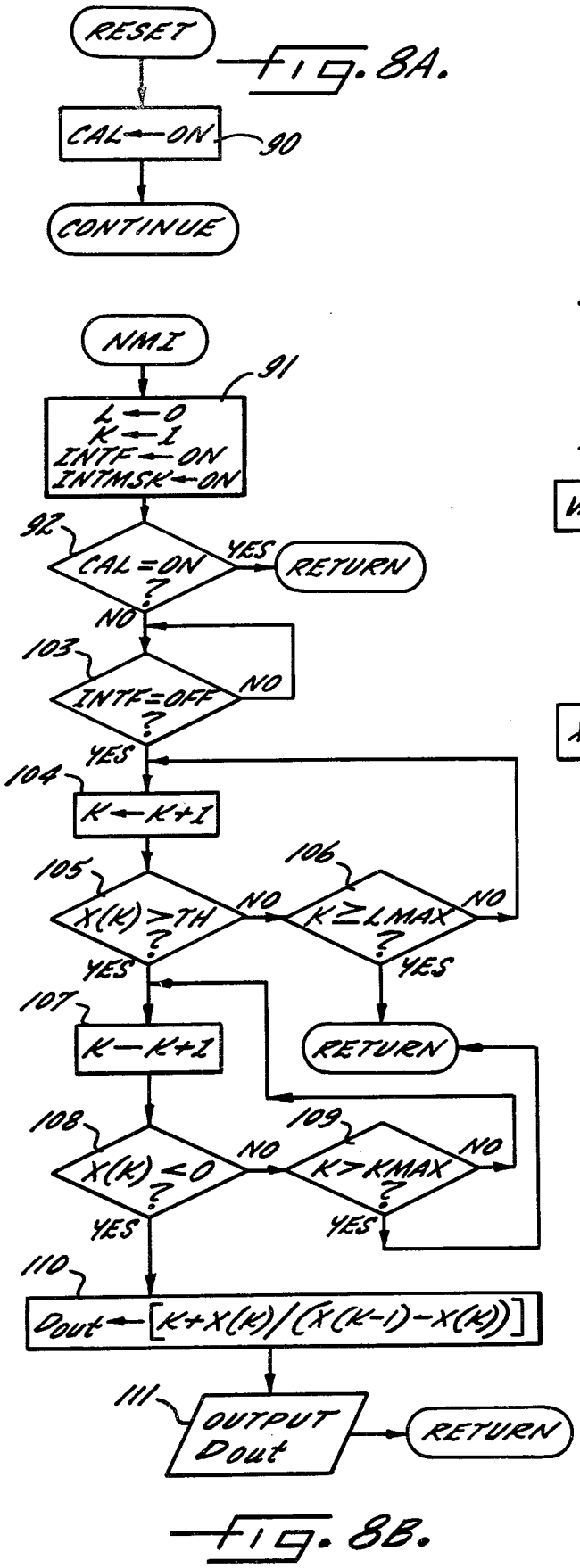
FIG. 8B.
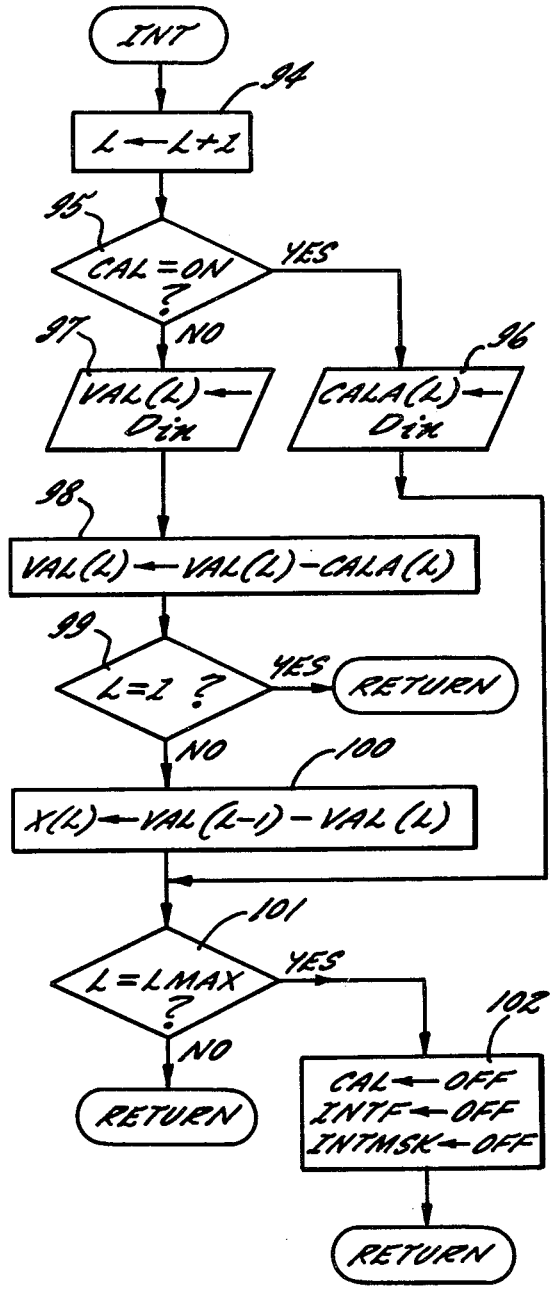
FIG. 8C.
FIG. 8A.

SYSTEM FOR ADJUSTING PRINTING PLATES MOUNTED ON PLATE CYLINDERS

This invention relates generally to an automatic control method and apparatus for adjusting printing plates mounted on plate cylinders, aligned in register with one another for the combined printing operation.

In multi-color printing machines, and particularly rotary presses, in which the printed sheet is printed in a plurality of colours in one pass through the machine, perfect printing requires that the printing plates roll on the sheets with exact register. In order to eliminate any differences due to the fitting of the plates on the cylinders, the individual cylinders are slidable axially and peripherally. This setting up of the cylinder adjustment is known as axial or side and circumferential or peripheral register adjustment. There is also a diagonal or skew adjustment required for exact register. This adjustment work for multi-color printing machines is very time-consuming and demanding on the press operators. Since in practice accurate adjustment of register was hitherto possible only by printing or running a number of proofs or test sheets, the considerable loss of time was also accompanied by a varying quantity of spoils. The press operator determines the amount of register adjustment for the plate cylinders of the various colors, for example, by visual inspection of alignment marks of the respective colors printed on the proofs.

It should be noted that once the proofs have been run, there are available automatic register adjusting means that are in practice controlled from a central control console to adjust the plate register by amounts specified by the press operator.

To reduce printing machine preparation time, various means and aids have been disclosed for initially adjusting the printing plates on the plate cylinders, although they do not reliably guarantee 100% register of the printing plates since only the positions of the printing plates relative to the associated cylinders are checked, and not the positions of the printing plates on the cylinders relative to one another. German Utility Model 7 245 711 discloses providing a plate cylinder with mountings at accurately defined points, said mountings having receiving bores adapted to receive a support with a reticle magnifier. With this device it is possible to bring the printing plate exactly into a predetermined position relative to the cylinder. But it is not possible to adjust the printing plates in register with each other since there is no relationship between the individual cylinders. Another optical magnifying device for measuring the alignment of printing plate with respect to its associated plate cylinder is disclosed in U.S. Pat. No. 4,033,259. With this device, peripheral reference marks at the ends of the plate cylinder can be viewed simultaneously with respective index marks on the printing plates.

The principal object of the invention is to provide a system which, before printing starts, enables the printing plates clamped on the plate cylinders to be aligned automatically in exact register with one another.

Another object of the invention is to check, before the first print, whether the printing plates are clamped so as to be aligned as close as possible to exact register prior to the start of printing.

Still another object of the invention is to eliminate the time-consuming adjustment of the printing plates relatively to one another.

Briefly, in accordance with the invention, known automatic means for adjusting the plate cylinders in response to register control signals are controlled by an automatic control system which measures the relative positions of the individual printing plates and compares the relative positions to a corresponding set of reference positions to generate the register control signals. The reference positions are preselected so that the control system tends to bring the printing plates in register with one another for the combined printing operation. In a preferred embodiment, the relative positions are referenced to registered plate cylinder zero positions that are in the middle of the adjustment ranges of the means for adjusting the plate cylinders. The printing plate having the least or minimum deviation from its plate cylinder zero position is selected as a reference and its set of position values are used as the preselected reference positions. Preferably, the relative and reference positions are stored, so that the comparison is easily adjusted to compensate for errors in the register of the plate cylinder zero positions. The sensing of relative positions, for example, is performed by optical scanners clamped to the press frame above the printing plates and which sense alignment marks copied on the printing plates in exact register. So that the press operator may comprehend the available range and current status of the register adjustment, the deviations of the printing plates are optically displayed in graphical form.

Other objects and advantages of the invention will become apparent upon reading the following detailed description and upon reference to the drawings in which.

Figure 1:
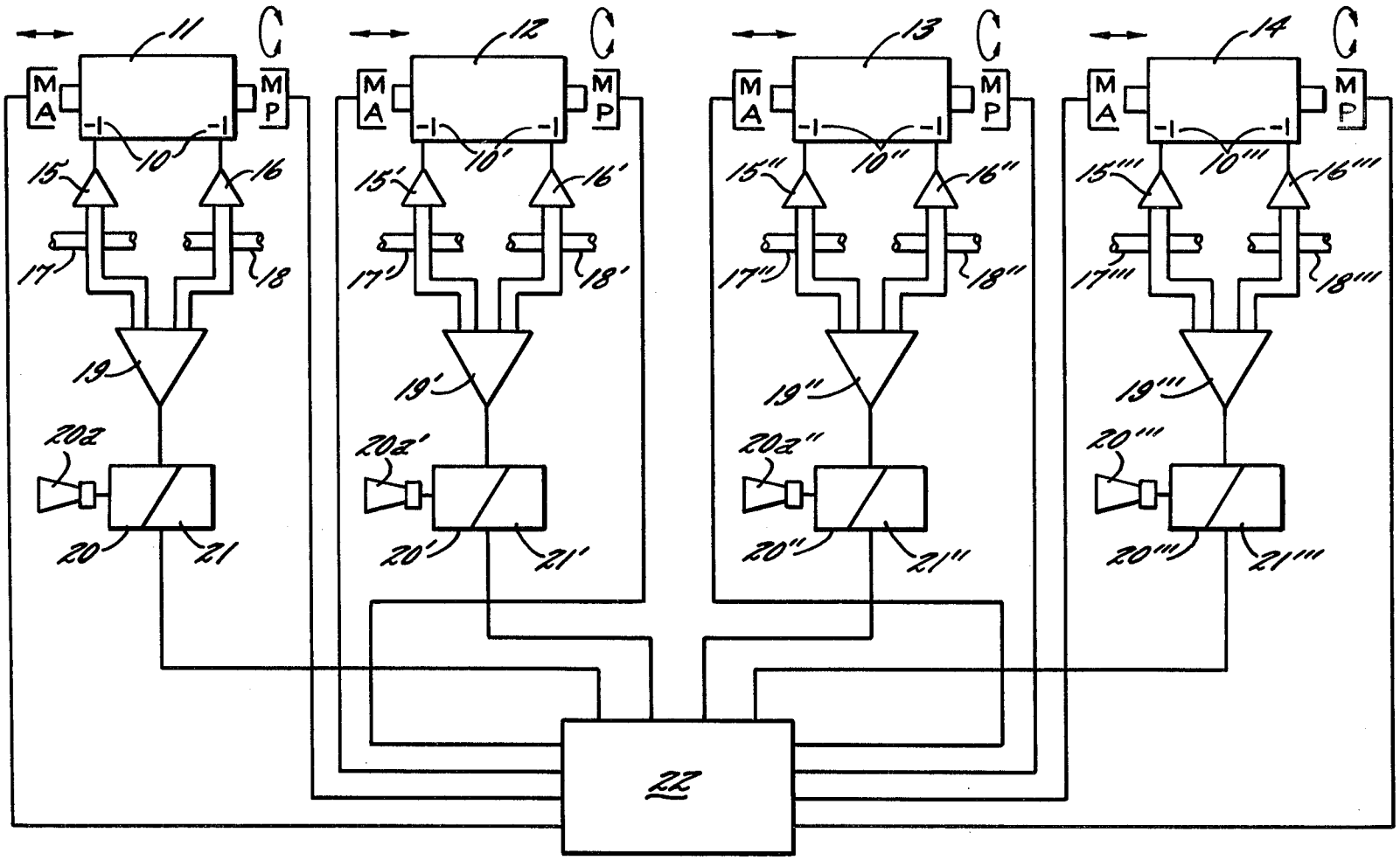
FIG. 1 is a block diagram of one embodiment of the invention for automatic register control of a printing press having four plate cylinders.
Figure 7:
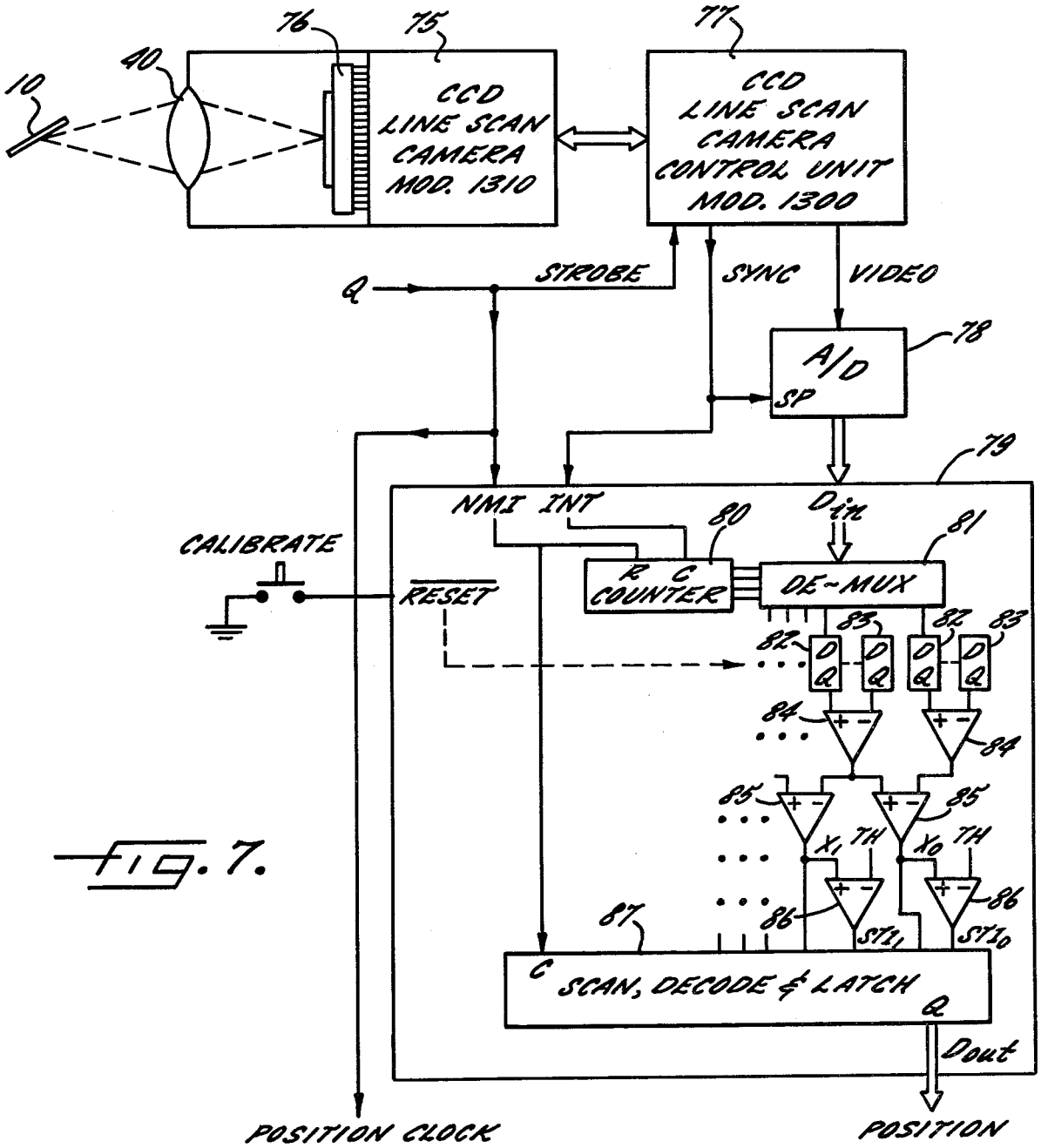

FIG. 7 is a block diagram of a CCD line scan camera generating a video signal and a numerical system for processing the video signal for detecting the position of an alignment mark within the wide field of view of the CCD sensor, for use in a digital embodiment of the invention as generally illustrated in FIG. 1; and FIGS. 8A, 8B and 8C are flowcharts for the reset, non-maskable interrupt, and maskable interrupt procedures executed by the microprocessor or numerical control computer in FIG. 7 to process the video signal and generate a numerical measure of the position of the alignment mark.

While the invention is susceptible to various modifications and alternative forms, specific embodiments thereof have been shown by way of example in the drawings and will herein be described in detail. It should be understood, however, that it is not intended to limit the invention to the particular forms disclosed, but, on the contrary, the intention is to cover all modifications, equivalents, and alternatives falling within the spirit and scope of the invention as defined by the appended claims.

Turning now to the drawings, there is shown in FIG. 1 a generalized block diagram of an exemplary embodiment of the invention. Two respective photoelectric scanning systems 15, 16 are associated with each plate cylinder 11, 12, 13, 14 at a defined distance from its outer surface. Each scanning system 15, 16 senses the axial and peripheral displacement of alignment marks 10 at a respective end of the associated plate cylinder. Servos $M_A$ and $M_P$ adjust the axial and peripheral register of the plate cylinders, respectively. Preferably, the displacement of the alignment marks is measured about registered plate cylinder zero positions in the middle of the adjustment range of the plate cylinders. The zero positions are determined, for example, by applying an alignment mark to a setting-up sheet and feeding the sheet through the press, while transferring the mark to the plate cylinders. The scanning systems 15, 16 are secured to holders 17, 18 which fix the scanning systems 15, 16 in relation to the machine frame (not shown) and thus reference the scanning systems to the plate cylinder zero positions.

Each pair of scanning systems 15, 16 is followed by an associated comparator circuit 19 which compares the two respective peripheral measured values determined by the associated pair of scanning systems 15, 16 and, if they are substantially equal, feeds them to an associated evaluator circuit 20. If the respective peripheral measured values detected by the associated scanning systems 15, 16 are not substantially identical, this condition is indicated to the press operator, e.g. optically or acoustically, by the evaluator circuit 20 having an alarm or indicator 20*a*. Moreover, if this condition occurs, the alarm signals that the associated printing plate is improperly clamped in at an angle, the angular deviation being a diagonal or skew register error which is corrected by the press operator. Alternatively, the diagonal or skew error is automatically adjusted to reduce the difference between the respective peripheral measured values, representing the skew register error, to substantially zero. If the signals from the scanning systems 15, 16 are substantially equal, they are first stored in the evaluator circuit 20 and then compared with the contents of a reference store 21. The reference store 21 contains the axial and peripheral coordinate values for a preselected zero position of the plate cylinders. The respective differences between the axial and peripheral store contents are fed to a central evaluator unit 22 and stored again. The same procedure is adopted with the measured values of the other scanning means 15, 16 denoted with single, double and triple primes for the other individual plate cylinders 12, 13, and 14.

When the central evaluator unit 22 has received the measured values from all the scanning systems, a comparison is carried out to select a new zero position or reference point for the plate cylinders. Preferably the new zero position or reference point (in terms of a coordinate pair of axial and peripheral measured values) is selected as the measured position of the printing plate having the smallest or minimum position deviation from the fixed absolute reference or plate cylinder zero positions established by the physical clamping of the scanning systems to the press frame. This particular selection for the new zero position tends to reduce the range of the adjustment and position deviation (it being assumed that the plate cylinders are initially in the middle of their respective adjustment ranges), and, as will be seen later for a particular embodiment, may ensure that the scanners operate within the most accurate or linear range of their response characteristics. Also, the printing plate selected as having the new zero position need not be adjusted by the automatic adjusting means so that residual error in its adjustment is eliminated.

The new difference values (referenced to the new zero position) now occurring between the other plate cylinders are converted to control variables and fed by the central evaluator unit to the servo motors $M_A$ and $M_P$ for the respective individual axial and peripheral register adjustments. The servo motors $M_A$, $M_P$ bring the printing plates on the individual plate cylinders 11-14 into register with one another.

In order to re-check the exact position of the individual printing plates on the plate cylinders 11-14 in relation to one another after the individual cylinder adjustment, the positions of the printing plates are again scanned and compared with one another, this being initiated by a trigger signal, when the plate cylinders 11-14 are in a defined position. When the central evaluator unit has received the measured values from all the scanning systems and if there is no substantial difference from the previously determined reference point, the printing plates are in register with one another. Thus, the automatic control system ensures that the printing plates are in exact alignment with one another.

It should be noted that the system may be calibrated after it is first set up by printing test sheets with alignment marks and inspecting the printed marks. If the central evaluator 22 incorporates a microprocessor or numerical computer so that the position values are temporarily stored in digital form, the initial calibration is facilitated. Then small errors in the register of the plate cylinder zero positions are corrected numerically by input of the measured calibration errors into the microprocessor or numerical computer where they are stored (preferably in nonvolatile memory) and later subtracted from the measured position values to generate adjusted position values. This numerical adjustment eliminates the need to physically readjust the clamped positions of the scanning systems each time the system is calibrated.

Figure 2:
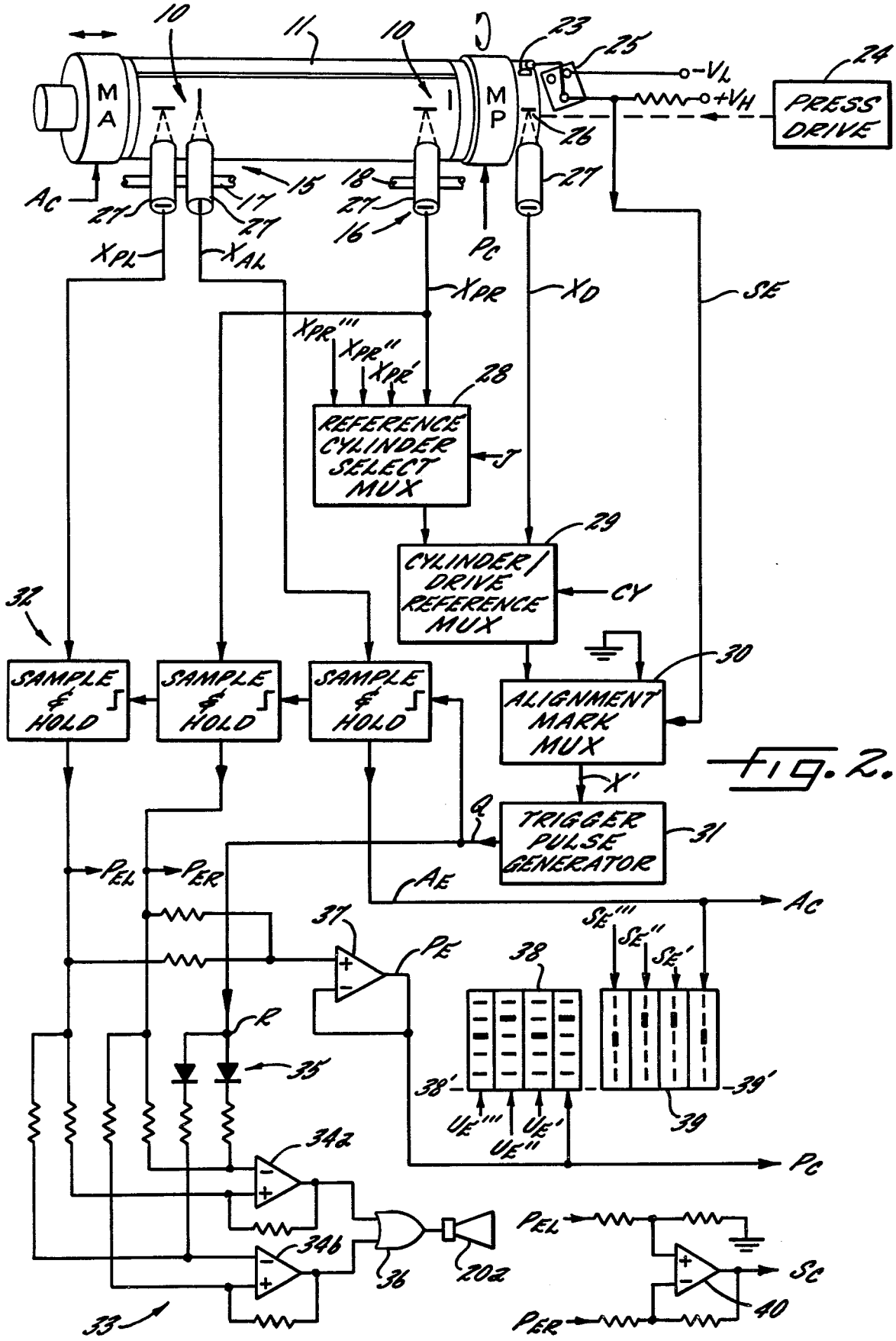
FIG. 2 is a block diagram of a specific embodiment of the invention which may use analog control circuits.

A particular embodiment of the invention is shown in FIG. 2. As will become evident, FIG. 2 shows the trigger pulse generating circuits 28, 29, 30 displays 38, 39 and the sensor circuits associated with one of the four plate cylinders 11, 12, 13, 14 shown in FIG. 1, it being understood that the sensor circuits are duplicated for the other plate cylinders 12, 13, 14.

A cam 23 or other means connected to the press drive 24 activates a switch 25 when the phase of the press drive 24 is within an angular range for which the alignment marks 10 are approximately within the field of view of the scanning means 15, 16. The switch 25 generates a sensor enable signal SE used to mask out or prevent the sensor circuits from being triggered or activated by marks or edges on the printing plates other than the desired alignment marks. Moreover, a peripheral alignment mark 26 synchronized to the press drive 24 is sensed by an optical scanner 27 in order to precisely reference the registered plate cylinder zero positions about which the peripheral register adjusting devices $M_P$ adjust the phase of the plate cylinders 11-14.

In order to obtain a precise reference point for the peripheral adjustment, a precise phase of one of the printing plates or the press drive must be selected as a zero or reference phase. In practical terms, one of the optical scanners sensing a peripheral alignment mark must be selected to generate a trigger pulse Q when the selected scanner is precisely aligned with its corresponding peripheral alignment mark. A reference cylinder select multiplexer 28, for example, accepts a control number J to select the output $X_{PR}$ of one of the right-hand peripheral scanners 16. In response to a select signal CY, a cylinder/drive reference multiplexer 29 selects the signal from the selected peripheral optical scanner or the signal $X_D$ from the optical scanner 27 sensing the peripheral alignment mark 26 synchronized to the press drive 24. The selected signal is passed to an output X' by an alignment mark multiplexer 30 enabled by the signal SE when the switch 25 is closed by the press drive cam 23. The signal X' is processed by a trigger pulse generator 31 to generate a trigger pulse Q precisely synchronized with the peripheral alignment mark 10, 26 selected by the multiplexers 28, 29. The multiplexers 28, 29, 30 are preferably analog switches having digital control inputs.

Once a trigger pulse is generated, it is used as a pulse or sample input to sample and hold circuits 32 which convert the position sensing signals $X_{PL}$, $X_{PR}$, and $X_{AL}$ from the scanners 27 to position values or register errors. The sample and hold circuits 32 are either analog sample and hold devices for an analog embodiment, or analog-to-digital converters for a digital embodiment. A sample and hold function must be performed since the scanner signals X are sensitive to the positions of the alignment marks 10 only during intermittent time periods. The sample and hold circuits 32 cooperating with the trigger pulse generating circuits are thus means for enabling the scanners or sensors 27 to generate electrical signals indicative of the relative positions of the alignment masks when the plate cylinders are at precisely defined angles of rotation.

In order to determine a diagonal or skew register error $S_C$, the lefthand and righthand peripheral register error signals $P_{EL}$ and $P_{ER}$, respectively, are compared, for example by a differential amplifier 40. In a digital embodiment, the number representing the righthand register error $P_{ER}$ is merely subtracted from the number representing the lefthand peripheral register error $P_{EL}$ and the difference multiplied by a suitable gain and scale factor.

In some printing presses, the diagonal or skew register error is corrected by manually unclamping and repositioning the printing plate. In such a case, when the magnitude of the skew register error exceeds a predetermined amount approximately zero, an indication or warning must be given to the press operator. For this purpose, a comparator circuit generally designated 33 as shown in FIG. 2 is comprised of two Schmitt triggers **34*a* and 34*b* which are sensitive to the two opposite polarities of the skew register error. In other words, when the difference between the lefthand peripheral error $P_{EL}$ and the righthand peripheral error $P_{ER}$ exceeds the threshold of a respective one of the Schmitt triggers 34*a*, 34*b*, depending on the polarity of the difference, the respective Schmitt trigger is activated. The Schmitt trigger outputs are fed to an OR gate 36 which then turns on the alarm or indicator 20*a*. A reset input R to the Schmitt triggers 34*a*, 35*b* is provided by directional diodes 35 connected to the negative inputs of the Schmitt triggers 34*a*, 34*b*. This reset input R is shown accepting the trigger pulse Q to put the Schmitt triggers in the proper initial states. In a digital embodiment, the comparison function is easily performed by calculating the absolute value or magnitude of the difference $P_{EL}-P_{ER}$ and comparing this difference to a small numerical threshold to determine whether the alarm 20*a*** should be activated.

The peripheral error $P_E$ is the average between the lefthand and righthand errors $P_{EL}$ and $P_{ER}$ as calculated by the summing amplifier 37. In a digital embodiment, a numerical average is easily calculated.

So that the press operator may comprehend the available range or current status of the register adjustment, the deviations of the printing plates are optically displayed in graphical form. These deviations could be either the register errors $A_E$ and $P_E$ themselves, or they may be the deviations of the cylinders 11-14 from the plate cylinder zero positions as obtained from position transducers which are typically included in the known register adjusting servo-mechanisms $M_A$, $M_P$. The register errors, for example, would tell the press operator whether the control system was properly functioning, while the actual deviations of the plate cylinders 11-14 from the plate cylinder zero positions would indicate the actual adjustment made by the register control mean $M_A$ and $M_P$ which could be useful for indicating whether the limits of the adjustment range are about to be reached. Preferably the optical display has a set of horizontal indicators 38 and a set of vertical indicators 39, the distance of the horizontal and vertical indicators from a reference line 38-39 being proportional to the deviation of the position of at least one of the printing plates on the plate cylinder, so that the press operator can easily distinguish the axial and peripheral deviations by associating them with the respective vertical and horizontal indicators. As shown in FIG. 2, the vertical and horizontal indicators are provided by LED analog bar graph displays having vertical and horizontal LED elements. In a digital embodiment, the display elements are preferably characters on an alphanumeric display driven by the microprocessor or numerical control computer which performs the above-mentioned numerical calculations and embodies the central evaluator unit 22 of FIG. 1.

It should be noted that the embodiment shown in FIG. 2 uses the sample and hold circuits 32 to compare the relative position signals X from the sensors 27 to the particular one of the peripheral register signals $X_{PL}$, $X_{PR}$, $X_D$ selected by the multiplexers 28, 29 as a reference position signal. The multiplexers comprise means for selecting a particular printing plate to define the corresponding reference position signals so that the reference position of the selecting printing plate is substantially zero. If, for example, the right peripheral register signal $X_{PR}$ is selected by the multiplexers, then the error $P_{ER}$ from the sample and hold circuits 32 is substantially zero, as will become evident below from the fact that the trigger pulse generator 31 outputs the trigger pulse Q when the selected peripheral signal X' has a value of zero.

A digital embodiment, however, may easily be provided with additional features for greater flexibility. In particular, if the sample and hold circuits 32 are digital circuits, then they may store and hold the values of the relative position signals X coincident with the plate cylinder zero positions when the multiplexers 29, 30 select the signal $X_D$. Preferably, the numerical control computer first adjusts the register servos $M_A$, $M_P$ to bring the plate cylinders to the middle ranges of their adjustable positions. Then, the numerical control computer sets the input CY to select the plate cylinder zero position signal $X_D$ so that the sample and hold circuits 32 store the positions of the printing plate register marks 10 referenced with respect to the zero positions of the plate cylinders. The numerical control computer calculates the magnitudes of these positions and finds the cylinder having the minimum deviation. Then the cylinder drive reference multiplexer 29 input CY is set to select a particular cylinder signal $X_{PR}$ and the reference cylinder select multiplexer 28 has its input J set to select that cylinder having the smallest deviation in its peripheral position about the plate cylinder zero position. Once the reference cylinder is selected, the sample and hold circuits 32 will hold the positions of the individual printing plates generally with respect to the peripheral position of the selected plate cylinder, so that the particular sample and hold circuit receiving the relative peripheral position of that particular cylinder will have an output of approximately zero. To further reduce the error in referencing the cylinders to the particular cylinder chosen as the reference cylinder, the relative position of the reference cylinder with respect to itself is stored and used as a numerical reference. This numerical reference is then compared to the relative peripheral positions of the other plate cylinders and the peripheral control signals $P_C$ are calculated as the differences between the relative positions and the numerical reference.

In a similar manner, the numerical control computer calculates the absolute values of the axial positions stored in the sample and hold circuits 32. It should be noted that the sample and hold circuit for only one axial position is shown in FIG. 2, it being understood that each individual cylinder 11-14 has an axial sample and hold circuit. The numerical control computer then determines which axial cylinder has the minimum deviation from the plate cylinder axial zero position and stores the corresponding axial position as a new axial zero reference position. This new axial reference position is subtracted from the relative axial positions of the other cylinders in order to compute the axial control signals $A_C$ for the axial servo motors $M_A$.

Figure 3:
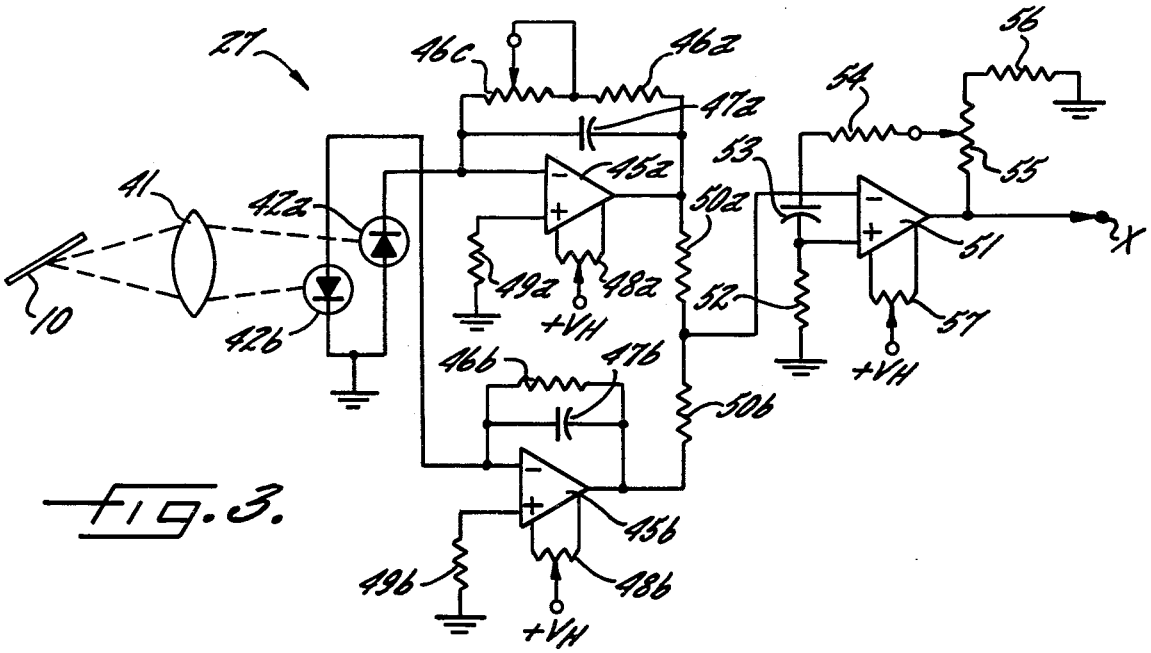
FIG. 3 is a schematic diagram of a differential amplifier and photodiode circuit comprising the optical scanners shown in FIG. 2.

An analog embodiment of the particular circuits shown in FIG. 2 is shown in FIGS. 3–6. The schematic for each optical scanner 27 is shown in FIG. 3. In order to generate an electrical signal that is a function of position about a reference position, a lens 41 is used to focus the image of the respective alignment mark 10 between two photodiodes 42a, 42b when the photodiodes and lens are at the zero reference position with respect to the alignment mark 10. The two photodiodes 42a, 42b are differentially connected so that the output signal X is precisely zero when the alignment mark is at the zero reference position, irrespective of the level of ambient illumination. But before the differential connection, each photodiode 42a, 42b has its own respective preamplifier 45a, 45b so that the gain of one of the preamplifiers 45a may be adjusted to match the gain of the other preamplifier 45b. The preamplifiers have gain setting feedback resistors 46a, 46b, band limiting feedback capacitors 47a, 47b null adjusting potentiometers 48a, 48b, and input biasing resistors 49a, 49b. A rheostat 46c is used in conjunction with the first feedback resistor 46a to relatively adjust the gain of the first preamplifier 45a. Summing resistors 50a and 50b are used to differentially combine the amplified outputs of the photodiodes 42a, 42b. A third amplifier 51, having an input bias resistor 52, a filter capacitor 53, a feedback resistor 54, and a gain setting potentiometer 55 and shunt resistor 56, amplifies the differential signal X to a sufficiently high level.

Figure 4:
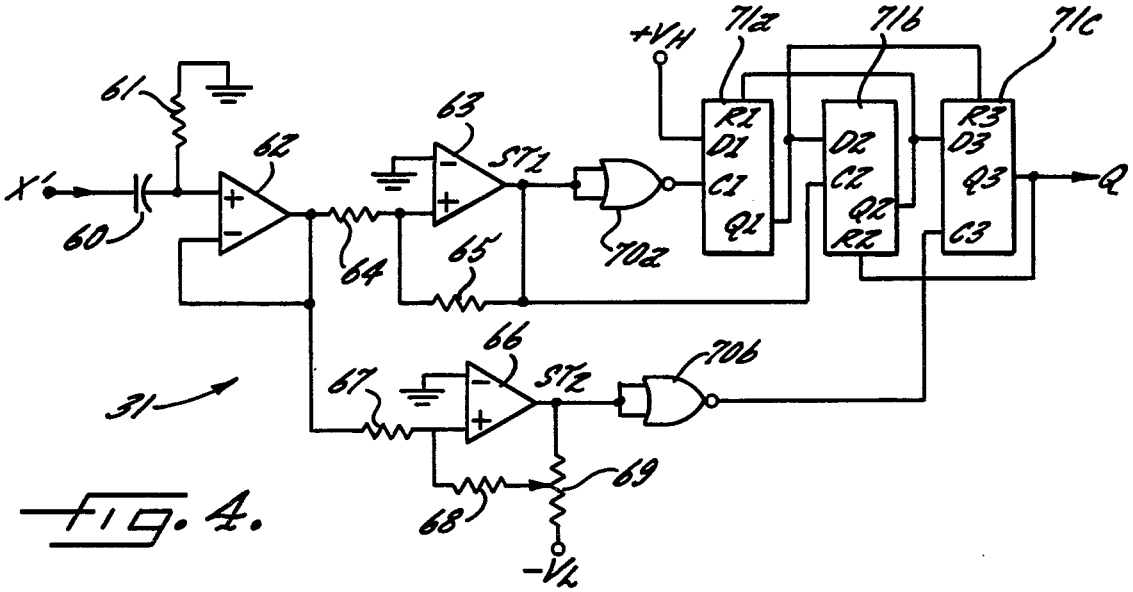
FIG. 4 is a schematic diagram of a trigger pulse generating circuit which accepts the output of the optical scanner circuit of FIG. 3.

The selected differential signal X' is processed by the trigger pulse generator 31 to generate a trigger pulse Q having a leading edge precisely aligned with the zero reference position. A particular embodiment of the trigger pulse generator 31 is shown in FIG. 4 and its operation may be understood by inspection of the timing diagram of FIG. 5. A high pass input filter comprising a series capacitor 60, a shunt resistor 61, and a follower 62 strips off any DC bias from the photo scanner 27 or the multiplexers 28, 29 and 30. A first Schmitt trigger comprising an operational amplifier 63, a series resistor 64 and a feedback resistor 65 is set for a high threshold and generates a binary signal ST1 when the differential signal X has a high magnitude indicating the presence of the reference mark 10. A second Schmitt trigger comprising an operational amplifer 66, a series resistor 67, a feedback resistor 68 and a threshold adjusting resistor 69 has a threshold set at the zero crossing 59 so as to generate a binary output ST2 having a falling edge aligned with the zero crossing 59. From the timing diagram in FIG. 5, it is observed that the desired output pulse Q is a logical AND of the first Schmitt trigger output ST1 and the complement of the second Schmitt trigger output ST2. Preferably the output Q is generated by inverting the first Schmitt trigger output ST1 with an inverter 70a and driving a set of D flip-flops 71a, 71b, 71c clocked by the complement of ST1, ST1, and the complement of ST2 as provided by an inverter 70b, respectively. Then there will only be one trigger pulse Q generated for each pulse of ST1 even if the second Schmitt output ST2 responds to noise and has multiple pulses coincident with each pulse of ST1.

Figure 5:
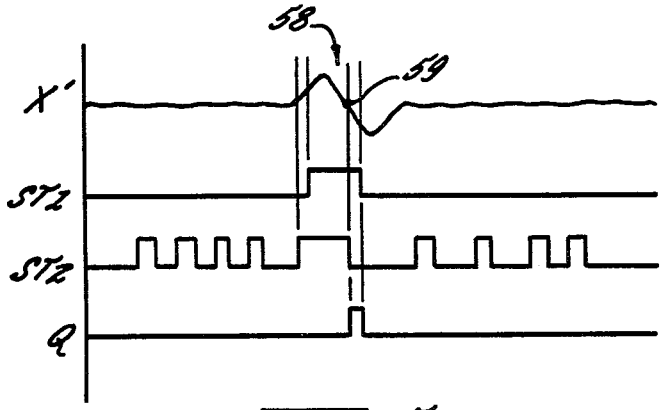
FIG. 5 is a timing diagram showing the operation of the trigger pulse generating circuit of FIG. 4.
Figure 6:
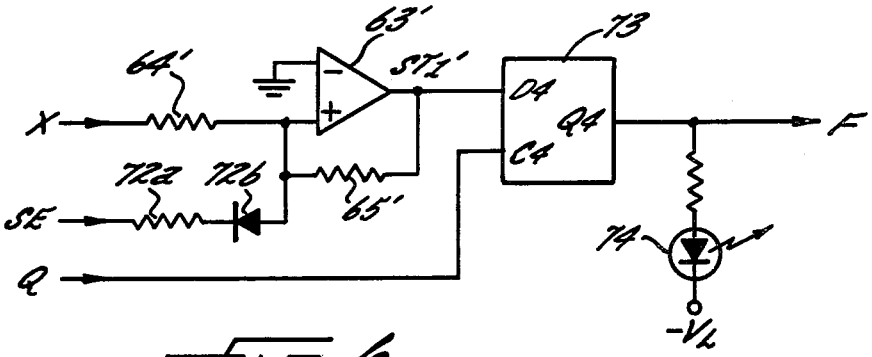
FIG. 6 is a schematic diagram of a circuit for indicating whether an alignment mark is within the field of view of the optical scanner shown in FIG. 3.

As is evident in FIG. 5, the trigger pulse Q can be used as a sampling pulse to determine relative positions from the differential signals X from any of the scanning sensors 27. This is evident from the fact that the output of any of the scanning sensors 27 has an S-shaped discriminator characteristic generally designated 58 in FIG. 5 about the zero crossing 59. But the characteristic is linear only around the zero crossing 59 between the maxima and minima of the characteristic curve 58. For this reason, the position errors $P_{ER}$, $P_{EL}$, $A_E$ at the outputs of the sample and hold circuits 32 should be used to determine control inputs $A_C$ and $P_C$ to drive the servos $M_A$ and $M_P$ to reduce the position errors to zero so that all of the differential signals X are sampled near their respective zero crossing 59.

To sense the position of the alignment marks 10, the differential signal X must be sampled on the characteristic curve portion 58 rather than at the extreme left or right where the alignment mark 10 is out of the view of the scanning sensors 27. One method of working around this constraint is to scan or drive the servos $M_A$ and $M_P$ from one end of their adjustment range to the other until the trigger pulse Q falls upon the characteristic curve portion 58. This condition is detected by the circuit shown in FIG. 6. The differential signal X is fed to another high threshold Schmitt trigger 63' having a series resistors 64' and a feedback resistor 65' to generate a similar binary signal ST1' which is centered upon the chracteristic curve portion 58. The Schmitt trigger 63' is disabled and reset by the complement of the sensor enable signal SE using an input resistor 72a and a directional diode 72b. A D flip-flop 73 is then used to detect coincidence of the sampling pulse Q and the binary signal ST1' generating a "found" logic signal F which is indicated to the operator by a LED 74, and, in a digital embodiment, is fed to the numerical control computer embodying the central evaluator unit 22 programmed to scan the servos $M_A$ and $M_P$ until the found signal F is detected.

An alternative to scanning with the servos $M_A$ and $M_P$ is to use an array of a large number of light sensing elements rather than just two photodiodes 42a, 42b. In such a case it is uneconomical to duplicate the circuitry of FIGS. 3, 4 and 6. Rather, it is more economical to multiplex the light sensing elements and process the video signal on a time sample basis.

As shown in FIG. 7, a charge coupled device or CCD line scan camera 75, such as model 1310 manufactured by Fairchild Corporation, has an integrated CCD circuit 76 with a plurality of light sensing elements. A CCD line scan camera control unit 77, such as Model 1300 manufactured by Fairchild Corporation, scans the light sensing elements in the integrated circuit 76 in response to the trigger pulse Q on its STROBE input. The line scan camera 77 multiplexes the light sensing elements in the integrated circuit 76 to generate an analog video signal and a synchronization or SYNC clock signal synchronized to the multiplexing of the individual light sensing elements. The synchronization signal SYNC is fed to the sampling input SP of an analog-to-digital converter 78 for accepting the VIDEO signals and generating a series of numerical values indicating the light intensity received by corresponding individual light sensing elements in the integrated circuit 76.

A microprocessor or numerical control computer 79 accepts the individual numerical values on an input port $D_{in}$ and also receives the SYNC signal on an interrupt input INT. Upon each of the SYNC signal transitions, an interrupt procedure directs the microprocessor 79 to demultiplex the input samples $D_{in}$ into an array of individual values corresponding to the individual light sensing elements in the integrated circuit 76. Each pair of adjacent numerical values corresponding to adjacent light sensing elements is processed in an analogous fashion to the analog circuits described in FIGS. 3, 4 and 6. In order to equalize the gains of the adjacent light sensing elements in each pair, the values for the ambient light level are stored in a corresponding calibration array 83 when the reset or CALIBRATE switch is depressed during an initial calibration step when the corresponding alignment mark 10 is not in view of the line scan camera 75. The calibration array is then subtracted 84 from the array of light level values and adjacent light level values are subtracted or compared 85 to each other to generate corresponding values of the differential signal $X_0$, $X_1$.... This array of diffential values is compared 86 to the predetermined threshold TH to generate another array of values $ST1_0$ $ST1_1$,....

The array of diffential values $X_0$, $X_1$,...is then scanned to perform the detection procedure of FIG. 5 as represented by the scan, decode and latch function 87 in FIG. 7. The microprocessor or numerical control computer 79 executes a non-maskable interrupt procedure which performs the scan, decode and latch function 87 by sequentially looking at the logic states of $ST1_0$, $ST1_1$... until one of these elements is a logical one indicating that the threshold TH has been exceeded by a particular value of the diffential signal X. Note that this means that the corresponding element of the differential value array X must be greater than 0 and the microprocessor or numerical control computer 79 may detect the image of the alignment mark by now looking sequentially at the following differential values X to determine the value of X which first falls below 0. The zero crossing is then determined precisely by linear interpolation between the positive value and the adjacent negative value of X.

A particular procedure for implementing the above-described function is shown in the flowcharts of FIGS. 8A, 8B and 8C. When the CALIBRATE switch is depressed, the CAL flag is set on in step 40 of FIG. 8A in order to pass the request to the interrupt procedure of FIG. 8C.

The non-maskable interrupt procedure of FIG. 8B is inititated by the trigger pulse Q. The array pointer L is set to 0 and the array pointer K is set to 1 and the interrupt flag INTF and interrupt mask INTMSK (enabling the maskable interrupt) are set on in step 91. The interrupt flag INTF reset by the interrupt procedure of FIG. 8C to signal that the differential value array X has been loaded by the interrupt procedure, as further described below. In step 92 the calibration flag CAL is tested to terminate the non-maskable interrupt procedure if the calibration flag is set, since another trigger pulse Q is required after calibration before the position array X is available for further calculations. Otherwise, in step 103 the interrupt flag INTF is tested so that execution of the non-maskable interrupt procedure is suspended until after the interrupt procedure of FIG. 8C has finished loading the array X of differential values.

Turning now to FIG. 8C describing the maskable interrupt procedure, upon each transition of the SYNC signal following the trigger pulse Q, the differential value array index or pointer L is incremented in step 94. If the CAL flag is on as tested in step 95, the calibration value $D_{in}$ is inputted and loaded into its corresponding calibration array location CALA(L), and the interrupt procedure terminates. Otherwise, in step 97 the light sensing element value $D_{in}$ is inputted and loaded into its corresponding value array location VAL(L). In step 98 the current value VAL(L) is corrected by subtracting its corresponding calibration array value CALA(L). Then the index L is tested and if it is equal to one, the interrupt procedure terminates since a corresponding differential value cannot be calculated from just one value. Otherwise, in step 100 a corresponding differential value X(L) is calculated. In step 101 the index L is compared to its maximum value LMAX (preset to the number of samples generated by the line scan camera 75 per trigger pulse Q), and if L is not equal to LMAX, the interrupt procedure terminates. Otherwise, the calibration flag CAL, interrupt flag INTF, and interrupt mask INTMSK are set off before termination of the interrupt routine, indicating that all of the samples have been processed.

Returning now to the non-maskable interrupt procedure of FIG. 8B, execution continues once the interrupt flag INTF is set off by step 102 of the maskable interrupt procedure, as tested in step 103. At this point all of the differential values have been loaded into the array X. In step 104 the differential value array index K is incremented, and in step 105 the individual values of X are successively compared to the threshold TH. If none of the values X(K) exceed the threshold TH, the non-maskable interrupt procedure will terminate when the index K is equal the preset maximum LMAX as tested in step 106. For the first value X(K) exceeding the threshold TH, scanning continues by incrementing the index K in step 107 but now in step 108 the first value of X(K) less than zero is tested for in step 108. Again, the procedure will terminate as tested in step 109 if none of the succeeding values of X(K) are less than zero. But upon the first value X(K) less than zero, an effective zero crossing is detected and its relative location, in terms of the units of distance equal to the separation of adjacent light sensing elements in the line scan camera 75 IC 79, is calculated by a linear interpolation equation in step 110. The distance is outputted in step 110 and the non-maskable interrupt procedure is finished until the next trigger pulse Q.

It should be noted that the line scan camera 75 has a wide field of view and the measured position is highly linear and arcuate over that range. Thus, any position offsets are easily corrected by a numerical offset or subtraction rather than a mechanical adjustment of the clamping or position of the scanners 27. In such a digital embodiment of FIG. 2, for example, the reference cylinder multiplexer 28 and the cylinder/drive reference multiplexer 29 are not needed, since referencing to a particular cylinder may be performed numerically by selecting the position value of a selected reference cylinder, obtained at the output of the corresponding microprocessor 79, as a numerical reference.

In view of the above, the automatic register control system according to the invention aligns the printing plates in exact register with one another. The alignment is performed quickly before printing starts, and improper printing plate clamping or set-up is also indicated.

What is claimed is:

1. An automatic control system for adjusting the printing plates mounted on the plate cylinders of a printing press having a plurality of plate cylinders comprising, in combination, automatic means for adjusting the plate cylinders in response to at least one register control signal for aligning the printing plates in register with another for the combined printing operation, means for automatically measuring the positions of the indiviudal printing plates with respect to the press frame to obtain relative position signals, means for automatically comparing the relative position signal for at least one of the printing plates to at least one corresponding predetermined reference position signal to generate at least one said register control signal, the reference position signal being preselected as a relative position signal for which the printing plates are substantially in register with one another for the combined printing operation, so that the means for adjusting tends to bring the printing plates in register with one another for the combined printing operation, and means for selecting a particular printing plate to define the corresponding reference position signal so that the corresponding register control signal for the selected printing plate is substantially zero, wherein the means for selecting has means for comparing the relative position signals and wherein the means for selecting selects the printing plate having a minimum relative position signal.

2. The combination as claimed in claim 1, further comprising a display having horizontal and vertical optical indicators, the distances of the horizontal and vertical indicators from respective reference lines being proportional to the deviation of the position of at least one of the printing plates on the plate cylinder, so that the press operator can easily distinguish the axial and peripheral deviations by associating them with the vertical and horizontal indicators.

3. An automatic control system for adjusting the printing plates mounted on the plate cylinders of a printing press having a plurality of plate cylinders driven in synchronism comprising, in combination, automatic means for adjusting the plate cylinders axially and peripherally about corresponding zero positions with respect to the press frame in response to respective axial and peripheral register control values for aligning the printing plates in register with one another for the combined printing operation, automatic means for measuring the axial and peripheral positions of the individual printing plates generally with respect to the zero positions of the respective plate cylinders to generate axial and peripheral position values, first automatic means for electronically storing the measured axial and peripheral position values, second automatic means for storing the position values for a particular one of the printing plates, automatic means for comparing the position values stored in first means to the position values stored in the second means and generating the respective control values as generally proportional to the respective differences between the stored position values, and a display having horizontal and vertical optical indicators, the distances of the horizontal and vertical indicators from respective reference lines being proportional to the deviation of the position of at least one of the printing plates on the plate cylinder, so that the press operator can easily distinguish the axial and peripheral deviations by associating them with the vertical and horizontal indicators, respectively.

4. The combination as claimed in claim 3, wherein the automatic means for measuring determines the positions of the printing plates at a predetermined angle of plate cylinder rotation and has photoelectric scanning means secured to the press frame at predefined distances above the printing plates for sensing the positions of the printing plates.

5. The combination as claimed in claim 3, wherin the second automatic means for storing the position values of a particular one of the printing plates has means for selecting the printing plate having a minimum deviation from the zero position of the corresponding plate cylinder to be in particular one of the printing plates.

6. An automatic control method for adjusting the register of printing plates mounted on the plate cylinders of a printing press having a plurality of plate cylinders driven in synchronism and having automatic means for adjusting the plate cylinder positions about plate cylinder zero positions in response to register control signals, the method comprising the steps of;

automatically measuring the positions of the individual printing plates with respect to the press frame to obtain relative position values, and automatically comparing the relative position values for at least one of the printing plates to a set of predetermined corresponding reference position values to generate the register control values, the reference position values being preselected as a set of relative position values for which the printing plates are substantially in register with one another for the combined printing operation, so that the means for adjusting tends to bring the printing plates in register with one another for the combined printing operation, wherein before the step of automatically measuring the positions, the plate cylinder zero positions are determined by transferring an alignment mark to the individual plate cylinders.

7. The method as claimed in claim 6, wherein the transferring of the alignment mark is performed by applying a corresponding mark to a setting-up sheet fed through the printing press.

8. An automatic control method for adjusting the register of printing plates mounted on the plate cylinders of a printing press having a plurality of plate cylinders driven in synchronism and having automatic means for adjusting the plate cylinder positions about plate cylinder zero positions in response to register control signals, the method comprising the steps of;

automatically measuring the positions of the individual printing plates with respect to the press frame to obtain relative position values, comparing corresponding relative position values for the printing plates and finding the relative position value having the minimum deviation from the corresponding zero position, and selecting as a reference plate the printing plate corresponding to the relative position value having the minimum deviation, selecting the set of relative position values measured for the reference plate as a set of corresponding reference position values, and automatically comparing the relative position values for at least one of the printing plates to the set of predetermined corresponding reference position values to generate the register control values, the reference position values thereby being preselected as a set of relative position values for which the printing plates are substantially in register with one another for the combined printing operation, so that the means for adjusting tends to bring the printing plates in register with one another for the combined printing operation.

9. An automatic control system for adjusting the printing plates mounted on the plate cylinders of a printing press having a plurality of plate cylinders comprising, in combination, automatic means for adjusting the plate cylinders in response to at least one register control signal for aligning the printing plates in register with another for the combined printing operation, means for automatically measuring the positions of the individual printing plates with respect to the press frame to obtain relative position signals, means for automatically comparing the relative position signal for at least one of the printing plates to at least one corresponding predetermined reference position signal to generate at least one said register control signal, the reference position signal being preselected as a relative position signal for which the printing plates are substantially in register with one another for the combined printing operation, so that the means for adjusting tends to bring the printing plates in register with one another for the combined printing operation, wherein the means for automatically measuring the positions of the individual printing plates with respect to the press frame include, for each printing plate, at least one peripheral register mark and at least one axial register mark on the printing plate, the peripheral register mark being at a right angle to the axial register mark, and photoelectric scanning means mounted to the press frame including, for each printing plate, a peripheral photo-sensor scanning the corresponding peripheral register mark and and axial photo-sensor scanning the corresponding axial register mark, the peripheral indication from the peripheral photo-sensor being generally independent of the axial indication from the axial photosensor.

10. The control system as claimed in claim 9, wherein the photo-sensors generate analog signals indicating the relative positions of the printing plates, and wherein the means for automatically comparing the relative position signal for at least one of the printing plates to at least one corresponding predetermined reference position signal comprise means for generating a sampling signal at a predefined angle of cylinder rotation, and means for sampling the analog signals generated by the photo-sensors in response to the sampling signal.

* * * * *